US008237614B2

(12) United States Patent
Kuramoto et al.

(10) Patent No.: US 8,237,614 B2
(45) Date of Patent: Aug. 7, 2012

(54) PLANAR ANTENNA, AND COMMUNICATION DEVICE AND CARD-TYPE TERMINAL USING THE ANTENNA

(75) Inventors: Akio Kuramoto, Tokyo (JP); Junichi Fukuda, Tokyo (JP)

(73) Assignee: NEC Corporation, Tokyo (JP)

( * ) Notice: Subject to any disclaimer, the term of this patent is extended or adjusted under 35 U.S.C. 154(b) by 361 days.

(21) Appl. No.: 12/528,141

(22) PCT Filed: Mar. 11, 2008

(86) PCT No.: PCT/JP2008/054358

§ 371 (c)(1), (2), (4) Date: Aug. 20, 2009

(87) PCT Pub. No.: WO2008/111578

PCT Pub. Date: Sep. 18, 2008

(65) Prior Publication Data

US 2010/0026586 A1 Feb. 4, 2010

(30) Foreign Application Priority Data

Mar. 12, 2007 (JP) ..... 2007-061900

(51) Int. Cl.
*H01Q 1/38* (2006.01)

(52) U.S. Cl. ..... 343/700 MS; 343/702; 343/846

(58) Field of Classification Search ..... 343/700, 343/702, 829, 846

See application file for complete search history.

(56) References Cited

U.S. PATENT DOCUMENTS 4,816,836 A * 3/1989 Lalezari ..... 343/700 MS
4,853,704 A * 8/1989 Diaz et al. ..... 343/767
6,281,843 B1 * 8/2001 Evtioushkine et al. 343/700 MS
6,603,429 B1 * 8/2003 Bancroft et al. ..... 343/700 MS
7,106,258 B2 * 9/2006 Kuramoto ..... 343/700 MS

FOREIGN PATENT DOCUMENTS

JP 7-030323 A 1/1995

(Continued)

OTHER PUBLICATIONS

International Search Report for PCT/JP2008/054358 mailed May 27, 2008.

(Continued)

*Primary Examiner* — Tho G Phan

(57) ABSTRACT

There are provided a planar antenna that reduces interactions between an antenna section and a peripheral circuit section on each other's electric operations in an apparatus in which an antenna and a peripheral circuit are arranged together on a printed circuit board, and a communication device and a card-type terminal that use the planar antenna. The planar antenna has the antenna section and the peripheral circuit section which are arranged on the printed circuit board. The planar antenna includes: on one surface of the printed circuit board, a plate element that constitutes the antenna section, a microstrip line that is connected with the plate element and feeds electricity from a peripheral circuit to the plate element, and a peripheral circuit mounting area in which the peripheral circuit section is arranged; and, on the other surface of the printed circuit board, a first ground portion that constitutes a ground-side conductor of the peripheral circuit section, and a second ground portion that constitutes a ground-side conductor of the microstrip line. The second ground portion is arranged on the printed circuit board other than the first ground portion. The connection between the plate element and the microstrip line is located on the side of the second ground portion away from the first ground portion.

14 Claims, 19 Drawing Sheets

FOREIGN PATENT DOCUMENTS

| | | | |
|---|---|---|---|
| JP | 2001274719 | A | 10/2001 |
| JP | 2002374116 | A | 12/2002 |
| JP | 2004056498 | A | 2/2004 |
| JP | 2005020369 | A | 1/2005 |
| JP | 2005045407 | A | 2/2005 |
| JP | 2005110123 | A | 4/2005 |
| JP | 2005175667 | A | 6/2005 |
| JP | 2006067252 | A | 3/2006 |
| JP | 2006121643 | A | 5/2006 |
| JP | 2006186969 | A | 7/2006 |

OTHER PUBLICATIONS

Japanese Office Action for JP2009-504052 issued Apr. 27, 2011.

* cited by examiner

FIG. 32A
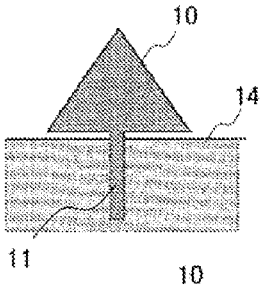
FIG. 32B
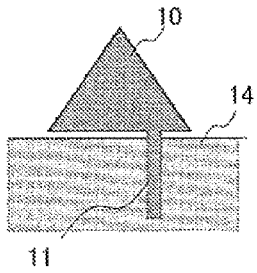
FIG. 32C
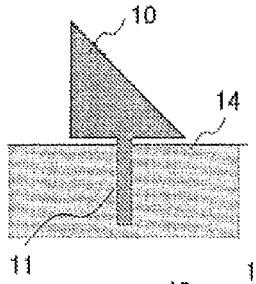
FIG. 32D
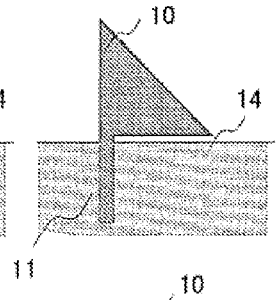
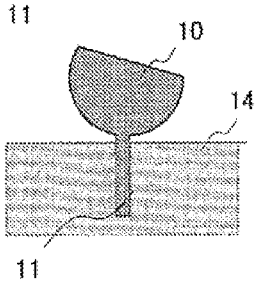
FIG. 32E
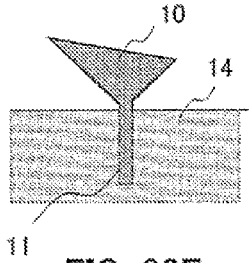
FIG. 32F
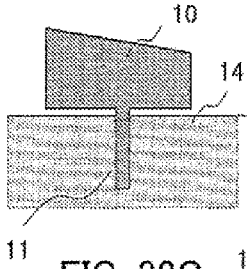
FIG. 32G
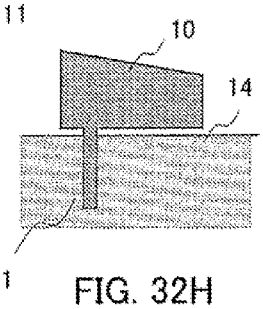
FIG. 32H
FIG. 33A
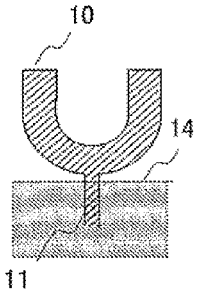
FIG. 33B
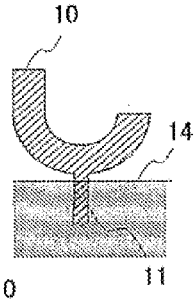
FIG. 33C
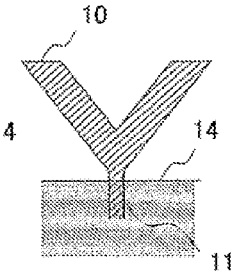
FIG. 33D
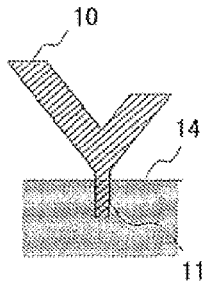
FIG. 33E
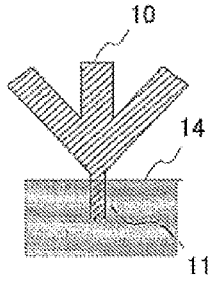
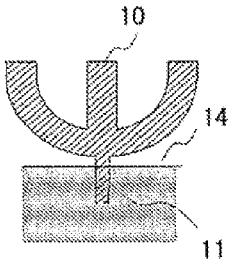
FIG. 33F
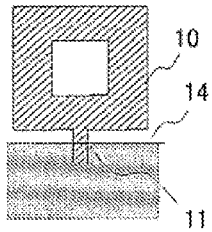
FIG. 33G
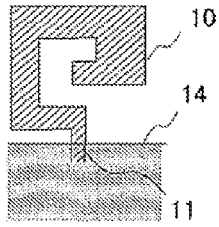
FIG. 33H
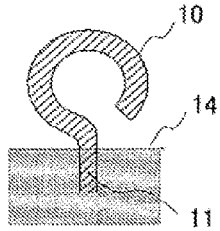
FIG. 33I FIG. 34A
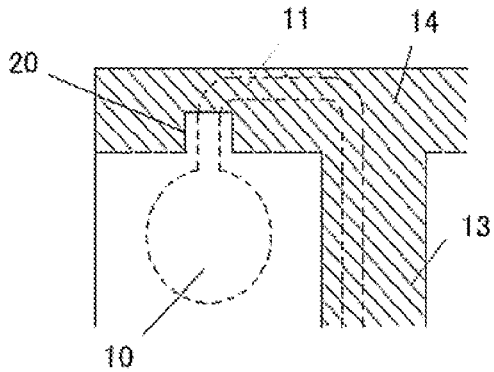
FIG. 34B
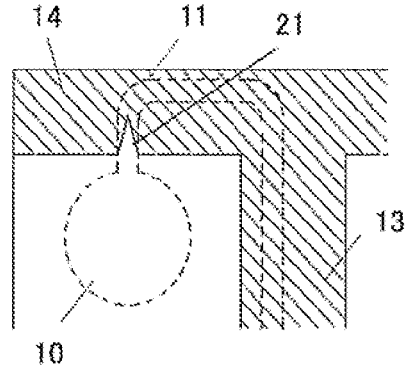
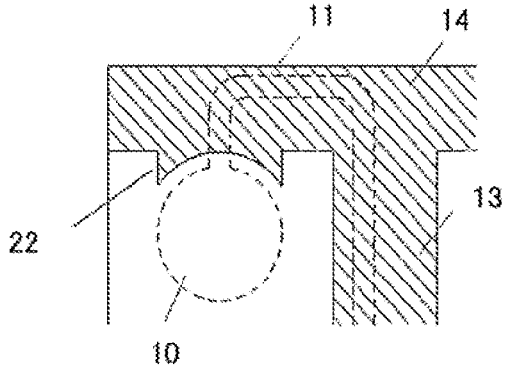
FIG. 34C
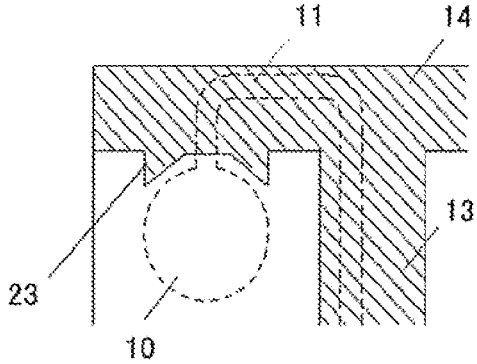
FIG. 34D

PLANAR ANTENNA, AND COMMUNICATION DEVICE AND CARD-TYPE TERMINAL USING THE ANTENNA

This application is the National Phase of PCT/JP2008/054358, filed Mar. 11, 2008, which is based upon and claims the benefit of priority from prior Japanese Patent Application No. 2007-061900, filed Mar. 12, 2007, the entire contents of which are incorporated herein by reference.

TECHNICAL FIELD

The present invention relates to a planar antenna, and a communication device and a card-type terminal using the antenna, and more particularly to an apparatus in which an antenna and a peripheral circuit are arranged together on a printed circuit board.

BACKGROUND ART

Card-type terminals have been known, examples of which include a card-type terminal that uses WiMAX (Worldwide Interoperability for Microwave Access) technologies, a card-shaped terminal that is used as an antenna when implementing a USB (Universal Serial Bus) wirelessly through the use of UWB (UltraWideBand) technologies, and other card-type terminals that use a wireless LAN (Local Area Network) or wireless technologies for data communication. One of the recent trends has been to enhance functionality for implementing such terminals as a single card-type terminal. A wideband antenna is thus absolutely essential for this kind of terminal.

FIG. 35 describes the configuration of an antenna of the related art for use in such a card-type terminal. In the diagram, a printed circuit board 100 has a first area (an area on the rear-end side of the card-type terminal) a1, which includes a circuit component mounting area of a peripheral circuit section, and a remaining second area (an area on the top-end side of the card-type terminal) a2 at different positions in one direction (Y direction in the diagram) so as to extend along another direction (X direction in the diagram) between the two mutually-orthogonal directions defined by the rectangular body (X and Y directions in the diagram). The first area a1 is provided with a microstrip line 111 and an underlying, ground conductor 112. The ground conductor 112 constitutes a ground-side conductor of the peripheral circuit section which is arranged in the circuit component mounting area, and a ground-side conductor of the microstrip line 111. Meanwhile, the second area a2 is provided with an antenna section which is connected with the microstrip line 111. The antenna section includes a circular plate element 110 which constitutes the antenna's radiating element. The circular plate element 110 is electrically fed by the peripheral circuit section through the microstrip line 111.

Patent Document 1 discloses a method of mounting an antenna on a wireless communication adaptor device. In the method, when a chip element and an antenna feeding point on a ground conductor plate are connected with a strip element, the strip element is laid so that an electrical length from the antenna feeding point to the top of the chip element is approximately one half the wavelength of the use frequency.

Patent Document 1: JP-A-2005-020369

SUMMARY OF THE INVENTION

Technical Problem

FIG. 36 is a diagram for describing the current distribution in the antenna of the related art shown in FIG. 35. As shown in FIG. 36, strong high-frequency currents f1 and f2 are seen in the plate element 110 along the periphery of the plate element 110 from near the feeding point where the microstrip line 111 is connected. In the meantime, strong high-frequency currents f10 and f11 are seen on the ground conductor 112 at the border edge of the ground conductor 112 near the connection with the plate element 110. High-frequency currents f12, f13, and f14 are also distributed in a radial pattern, though not as strong as the high-frequency currents f10 and f11.

Consequently, the high-frequency currents f1 and f2 and the high-frequency currents f10 to f14 concentrate on the plate element 110 and on a side of the ground conductor 112 opposite the plate element 110, respectively, and flow into the circuit component mounting area 200 of the same printed circuit board 100 where peripheral circuits are also arranged. As a result, the antenna section and the peripheral circuit section affect and are affected by each other's electrical operations due to the presence of each other. For example, if electronic components are arranged on a portion where the high-frequency current f14 flows, problems are likely to occur such that the circuits of that portion become unstable, the plate element 110 causes an impedance mismatch, and efficient radiation is no longer possible.

The antenna used in the card-type terminal of the related art has often been formed on the printed circuit board by etching. With this method, however, the antenna's high-frequency currents flow around where the antenna is arranged, as described above, and the presence of the antenna can electrically affect and be affected by the peripheral circuits that are also arranged nearby on the same printed circuit board. In consequence, the related art has had such problems as the unstable operation of the antenna or peripheral circuits, the occurrence of impedance mismatching, and deviations in the resonance frequency.

It is described that the method of mounting an antenna on a wireless communication adaptor device of Patent Document 1 increases the impedance on the chip antenna side when viewed from the antenna feeding point, so that an opposite-phase component of current to be induced on the ground conductor plate by the transmission output from the chip antenna can be suppressed to improve the antenna gain in the front direction of the circuit board irrespective of the position of the antenna feeding point. Patent Document 1, however, does not address the foregoing effect of antenna's high-frequency currents on the peripheral circuit section in an apparatus where the antenna section and the peripheral circuit section are arranged together on a printed circuit board. Patent Document 1 therefore still entails the same problems as the foregoing.

The present invention has been achieved in order to solve the foregoing problems. It is thus an object of the present invention to reduce interactions between an antenna section and a peripheral circuit section on each other's electrical operations due to the presence of each other in an apparatus where an antenna and a peripheral circuit are arranged together on a printed circuit board.

Solution to Problem

To achieve the foregoing object, a planar antenna according to the present invention is a planar antenna including an antenna section and a peripheral circuit section arranged on a printed circuit board, the planar antenna comprising: on one surface of the printed circuit board, a plate element that constitutes the antenna section, a microstrip line that is connected with the plate element and feeds electricity from a peripheral circuit to the plate element, and a peripheral circuit mounting area in which the peripheral circuit section is arranged; and, on the other surface of the printed circuit board, a first ground portion that constitutes a ground-side conductor of the peripheral circuit section, and a second ground portion that constitutes a ground-side conductor of the microstrip line, the second ground portion being arranged on the printed circuit board other than the first ground portion, a connection between the plate element and the microstrip line being located on the side of the second ground portion away from the first ground portion.

Advantageous Effects of Invention

According to the present invention, it is possible to significantly reduce interactions between an antenna section and a peripheral circuit section on each other's electrical operations due to the presence of each other in an apparatus where an antenna and a peripheral circuit are arranged together on a printed circuit board.

BRIEF DESCRIPTION OF DRAWINGS

FIGS. 32A to 32H are diagrams showing the shapes of a plate element of a wideband planar antenna.

FIGS. 33A to 33I are diagrams showing other shapes of a plate element of a wideband planar antenna.

FIGS. 34A to 34D are diagrams showing the shapes of a matching circuit of a wideband planar antenna.

EXPLANATION OF REFERENCE

Figure 1:
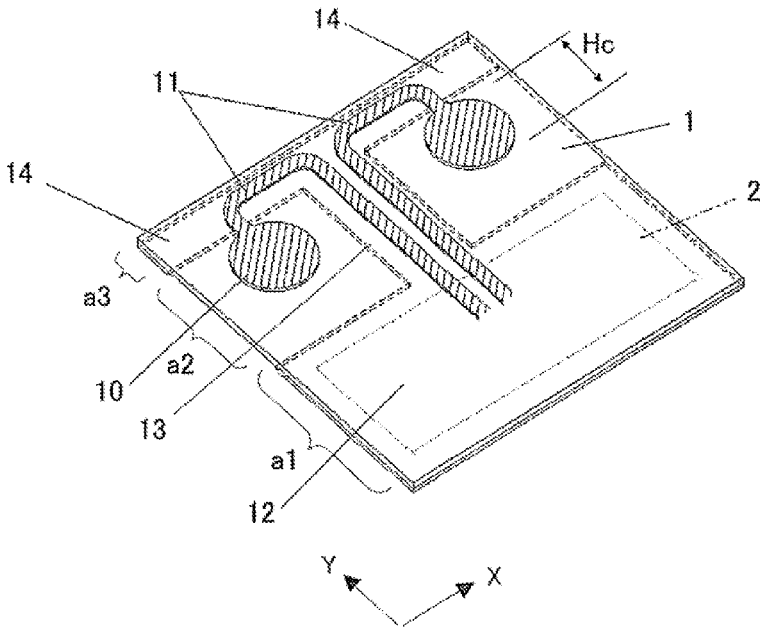
FIG. 1 is a perspective view showing the configuration of a wideband planar antenna according to a first example of the present invention.

1: printed circuit board
1*a*: front side
1*b*: back side
2: circuit component mounting area of a peripheral circuit section
10, 10*a*, 10*b*: plate element (antenna section)
11, 11*a*, 11*b*: microstrip line
12: first ground conductor (first ground portion)
13: second ground conductor (second ground portion)
14: third ground conductor (third ground portion)
20, 21: notch for impedance matching
22, 23: fin for impedance matching
a1: first area
a2: second area
a3: third area
f1, f2, f10 to f14: high-frequency current

DESCRIPTION OF EMBODIMENTS

Now, an exemplary embodiment of the planar antenna according to the present invention and a communication device and card-type terminal using the planar antenna will be described in detail with reference to the drawings.

The wideband planar antenna according to the exemplary embodiment is for use in a communication device, particularly such as a card-type terminal that uses WiMAX technologies, a card-type terminal that is used as an antenna when implementing a USB (Universal Serial Bus) wirelessly through the use of UWB (Ultra WideBand) technologies, and other card-type terminals that use a wireless LAN (Local Area Network) or wireless technologies for data communication.

There are various kinds of terminals using a wide variety of recent communication technologies. For example, communication services using WiMAX technologies are going to be launched worldwide in 2.5-GHz and 3.5-GHz frequency bands. Such technologies can also be employed for card-type wireless personal network terminals using UWB technologies and card-type terminal for multiband wireless LAN. The wideband planar antenna according to the exemplary embodiment is applicable to such card-type terminals.

The wideband planar antenna of the exemplary embodiment can be easily formed by etching on a top portion of the printed circuit board of a PCMCIA (Personal Computer Memory Card International Association) card which is used for personal computers etc., or of a similar card device, and has wideband characteristics. The antenna has the function of reducing electrical interactions with peripheral circuits that are also arranged nearby on the same printed circuit board.

The wideband planar antenna of the exemplary embodiment has plate elements of, for example, circular shape, elliptic shape, semicircular shape, pentagonal shape, triangular shape (such as an obtuse triangle and a right triangle), or other arbitrary polygonal shape. Microstrip lines are connected to the plate elements at one end each. The ground conductors (second ground portion) of the microstrip lines are arranged on a surface of the printed circuit board opposite from the surface of the printed circuit board where the plate elements are arranged. The ground conductors are arranged on the top-end side of the printed circuit board away from the ground conductor (first ground portion) of the peripheral circuit section which is arranged on the rear-end side of the printed circuit board.

Specific examples of the present invention will be described below.

EXAMPLE 1

Figure 2A:
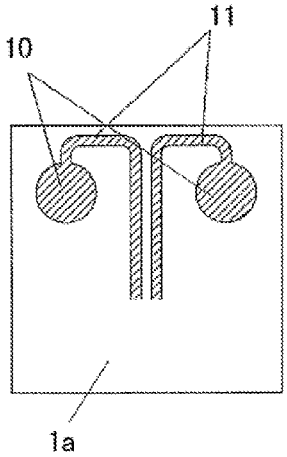
FIGS. 2A to 2C are plan views of the wideband planar antenna according to the first example of the present invention, FIG. 2A being a top view, FIG. 2B a rear view, and FIG. 2C a phantom view.
Figure 2B:
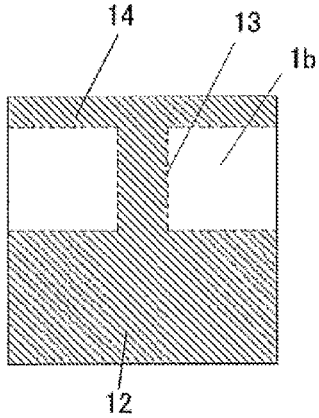
Figure 2C:
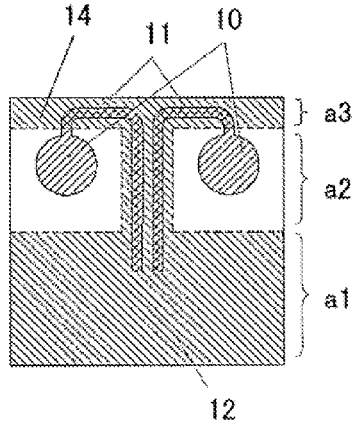

FIG. 1 is a perspective view of a wideband planar antenna according to a first example of the present invention. FIGS. 2A to 2C are plan views of FIG. 1. FIG. 2A shows a front view in perspective, FIG. 2B a rear view, and FIG. 2C a phantom view.

The wideband planar antenna shown in FIGS. 1 and 2A to 2C has a rectangular printed circuit board 1 made of dielectric material. The printed circuit board 1 has a first area a1, which includes a circuit component mounting area 2 of a peripheral circuit section (not shown), and remaining second and third areas a2 and a3 at different positions in a Y direction so as to extend along an X direction between the two mutually-orthogonal directions defined by the rectangular body (for convenience' sake, a predetermined direction that defines the front end and the rear end of the planar antenna (printed circuit board 1) will hereinafter be referred to as the "Y direction", and the direction orthogonal to the Y direction will be referred to as the "X direction"). That is, the first area a1 on the bottom-end side of the planar antenna (printed circuit board 1) and the third area a3 on the top-end side of the card-type terminal are spaced apart from each other across the second area a2 in the center.

The surface 1*a* of the printed circuit board 1 is provided with two plate elements 10 which are made of circular bodies to be used as antenna's radiating elements, and two microstrip lines (transmission lines) 11 which are respectively connected with the two plate elements 10.

The two plate elements 10 are made of a conductor formed on the surface 1*a* of the printed circuit board 1 by etching, and are arranged at respective ends across a central part of the second area a2 in the X direction. The plate elements 10 are connected with the microstrip lines 11 at one axial end each, with the other axial ends as open ends. The axial end-to-end length of the plate elements 10, i.e., the circle diameter Hc is set at approximately ¼ the wavelength of the lowest use frequency.

The two microstrip lines 11 are made of a conductor formed on the surface 1*a* of the printed circuit board 1 by etching. The microstrip lines 11 extend in parallel from a central part of the first area a1 in the X direction through the central part of the second area a2 to the third area a3, where the microstrip lines 11 are branched off in opposite directions toward the respective ends in the X direction, curved in the middle, and connected with the ends of the respective plate elements 10. That is, the microstrip lines 11 are connected with the plate elements 10 at the border between the third area a3 and the second area a2 away from the first area a1. This is one of the differences from the foregoing related art.

Figure 35:
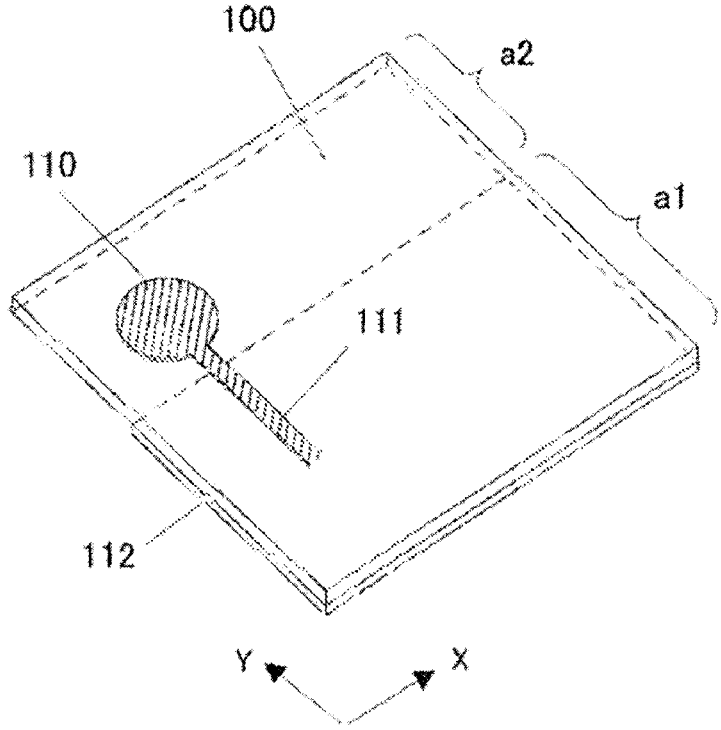
FIG. 35 (PRIOR ART)
FIG. 35 is a perspective view showing the configuration of an antenna according to the related art.
Figure 36:
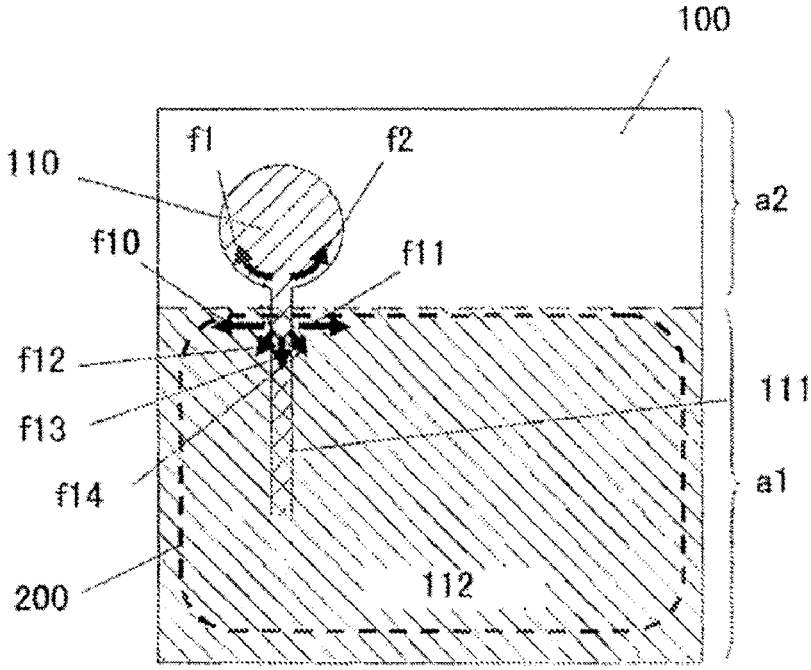
FIG. 36 (PRIOR ART)
FIG. 36 is a plan view for describing the current distribution in the antenna of the related art.

The backside 1*b* of the printed circuit board 1 is provided with a first ground conductor 12 corresponding to the ground conductor 112 shown in FIG. 35 described above. In the present example, a second ground conductor 13 and a third ground conductor 14 are also formed on the backside 1*b* by etching.

Like the ground conductor 112 of FIG. 35 described above, the first ground conductor 12 functions as both a ground-side conductor of the peripheral circuit section and a ground-side conductor of the microstrip lines 11. The first ground-conductor 12 is arranged over the entire first area also as to be opposed to the circuit component mounting area 2 across the printed circuit board 1.

The second ground conductor 13 functions as a ground-side conductor of the microstrip lines 11. The second ground conductor 13 is arranged in the central part of the second area a2 in the X direction so as to be opposed to the two microstrip lines 11 across the printed circuit board 1, in a rectangular configuration extending in the Y direction.

The third ground conductor 14 also functions as a ground-side conductor of the microstrip lines 11. The third ground conductor 14 is arranged in the third area a3 so as to be opposed to the two microstrip lines 11 across the printed circuit board 1, in a rectangular configuration extending in the X direction.

As described above, a difference from the foregoing related art consists in that while the first ground conductor 12 is formed in the first area a1 on the bottom-end side (where the circuit component mounting area 2 is arranged) of the printed circuit board 1, the ground-side conductors of the microstrip lines 11 (the second ground conductor 13, the third ground conductor 14) are formed in the areas other than the first area a1, i.e., the second area a2 and the third area a3 at the central part and the top-end side (where the circuit component mounting area 2 is not arranged) of the printed circuit board 1. Here, the first ground conductor 12 constitutes a first ground portion, and the second ground conductor 13 and the third ground conductor 14 constitute a second ground portion.

In such a configuration, the first ground conductor 12 is arranged on the bottom-end side of the printed circuit board 1, and the second ground conductor 13 and the third ground conductor 14 are arranged on the path that leads from the bottom-end side through the central part to the top-end side of the printed circuit board 1. The connections (feeding points) between the plate elements 10 and the microstrip lines are then located on the side where to face the third ground conductor 14 which is arranged on the top-end side of the printed circuit board 1, away from the first ground conductor 12 which is arranged on the bottom-end side of the printed circuit board 1.

Figure 3:
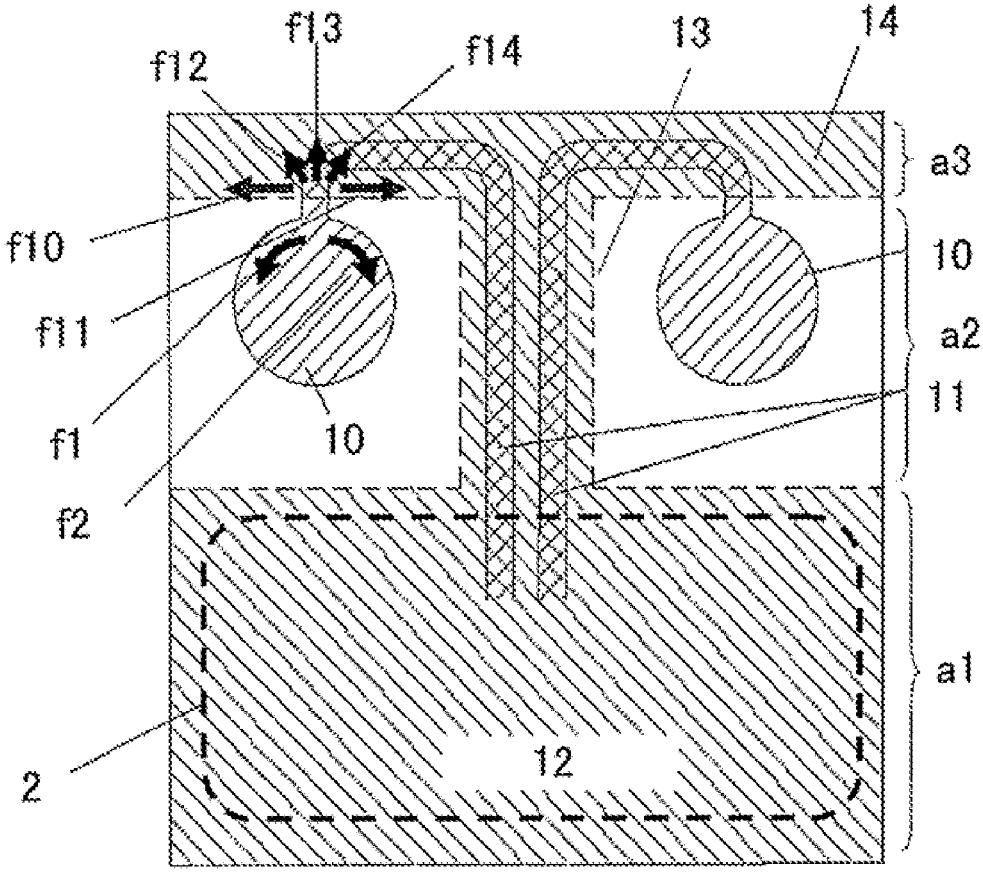
FIG. 3 is a plan view for describing the current distribution in the wideband planar antenna according to the first example of the present invention.

FIG. 3 is an explanatory diagram of the current distribution in the wideband planar antenna of the present example.

As shown in FIG. 3, strong high-frequency currents f1 and f2 are seen in the plate elements 10 along the peripheries of the plate elements 10 from near the feeding points where the microstrip lines 11 are connected. In the meantime, strong high-frequency currents f10 and f11 are seen on the third ground conductor 14 at the border edge of the third ground conductor 14 near the connections with the plate elements 10. High-frequency currents f12, f13, and f14 are also distributed in a radial pattern, though not as strong as the high-frequency currents f10 and f11.

Consequently, the high-frequency currents f1 and f2 and f10 to f14 concentrate on the plate elements 10 of the antenna section and on one side of the third ground conductor 14 opposite the plate elements 10, respectively, in the vicinities of the connections between the plate elements 10 and the microstrip lines 11 away from the circuit component mounting area 2 of the peripheral circuit section, and little flows into the peripheral circuit section. In consequence, the present example provides the effect of significantly reducing interactions between the antenna section and the peripheral circuit section on each other's electrical operations due to the presence of each other.

EXAMPLE 2

Figure 4:
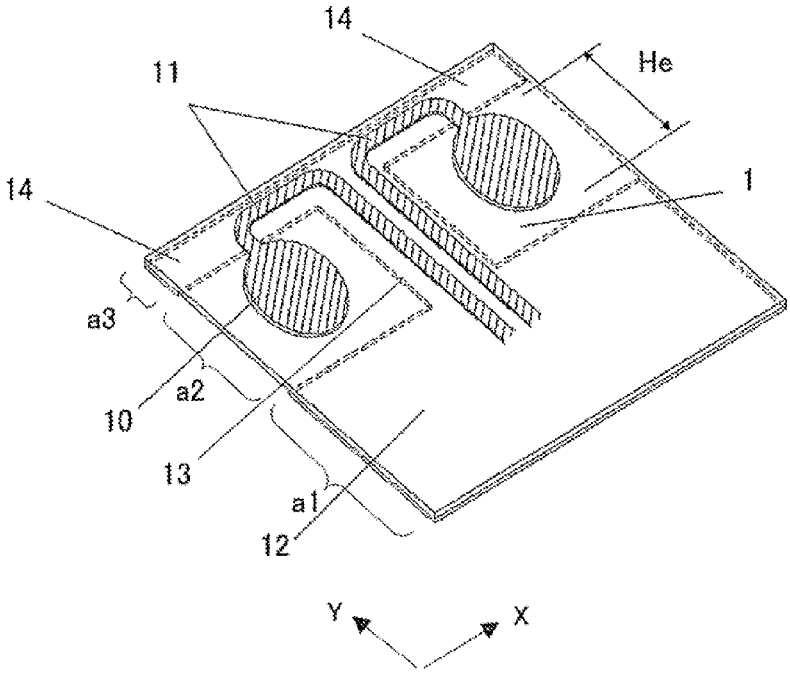
FIG. 4 is a perspective view showing the configuration of a wideband planar antenna according to a second example of the present invention.
Figure 5A:
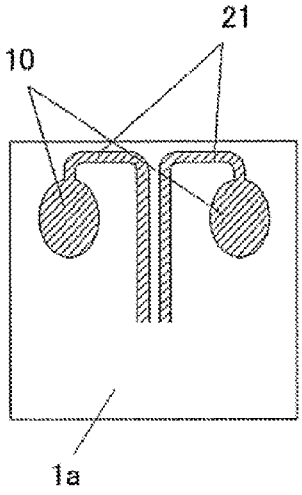
FIGS. 5A to 5C are plan views of the wideband planar antenna according to the second example of the present invention, FIG. 5A being a top view, FIG. 5B a rear view, and FIG. 5C a phantom view.
Figure 5B:
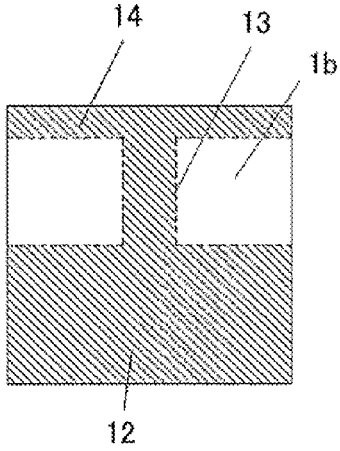
Figure 5C:
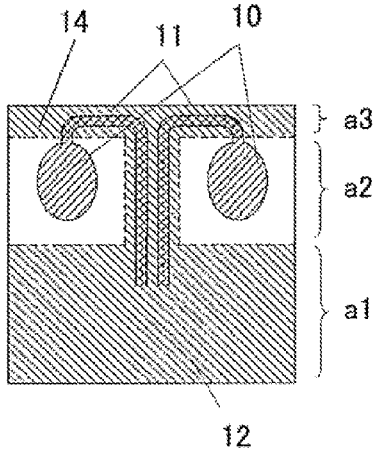

FIG. 4 is a perspective view of a wideband planar antenna according to a second example of the present invention. FIGS. 5A to 5C are plan views of FIG. 4. FIG. 5A shows a front view in perspective, FIG. 5B a rear view, and FIG. 5C a phantom view.

In the present example, the shape of the bodies of the plate elements 10 according to the first example is replaced with an elliptic shape. Here, the length (height) He of the plate elements 10 across the axial ends is set at approximately ¼ the wavelength of the lowest use frequency. The rest of the configuration is the same as that of the first example. Like reference symbols will thus be given, and description thereof will be omitted. The present example provides the same effect as that of the first example.

EXAMPLE 3

Figure 6:
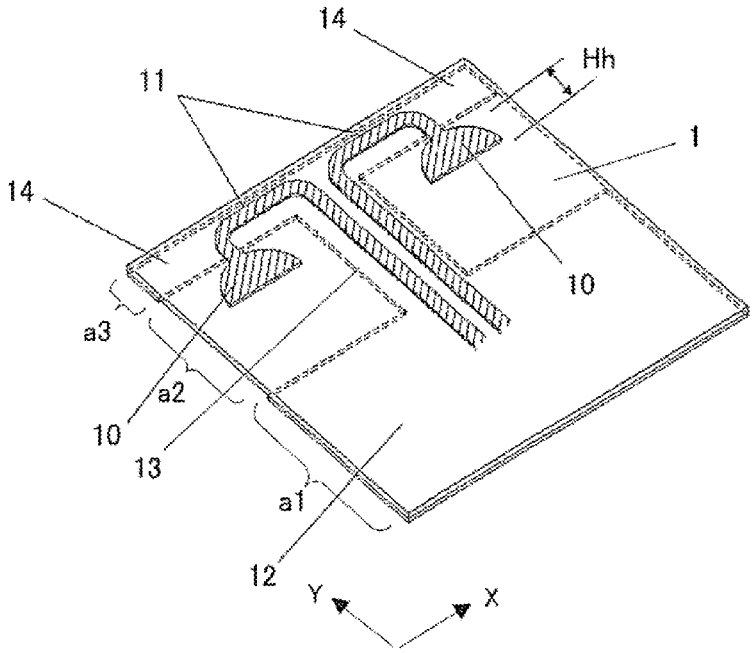
FIG. 6 is a perspective view showing the configuration of a wideband planar antenna according to a third example of the present invention.
Figure 7A:
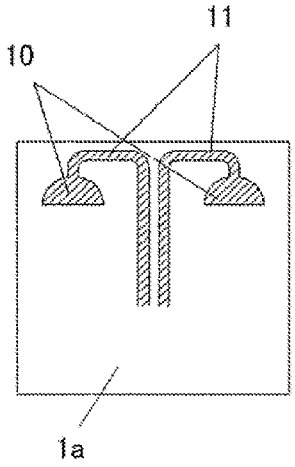
FIGS. 7A to 7C are plan views of the wideband planar antenna according to the third example of the present invention, FIG. 7A being a top view, FIG. 7B a rear view, and FIG. 7C a phantom view.
Figure 7B:
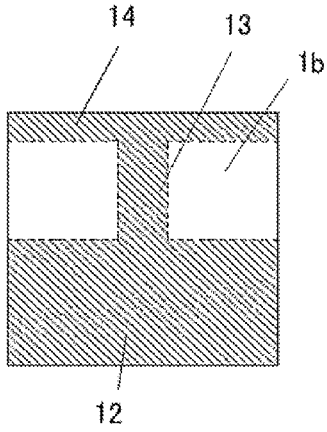
Figure 7C:
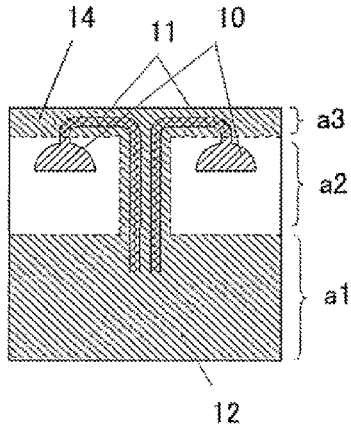

FIG. 6 is a perspective view of a wideband planar antenna according to a third example of the present invention. FIGS. 7A to 7C are plan views of FIG. 6. FIG. 7A shows a front view in perspective, FIG. 7B a rear view, and FIG. 7C a phantom view.

In the present example, the shape of the bodies of the plate elements 10 according to the first example is replaced with a semicircular shape. Here, the length (height) Hh of the plate elements 10 across the axial ends is approximately ¼ or so the wavelength of the lowest use frequency. The rest of the configuration is the same as that of the first example. Like reference symbols will thus be given, and description thereof will be omitted. The present example provides the same effect as that of the first example.

EXAMPLE 4

Figure 8:
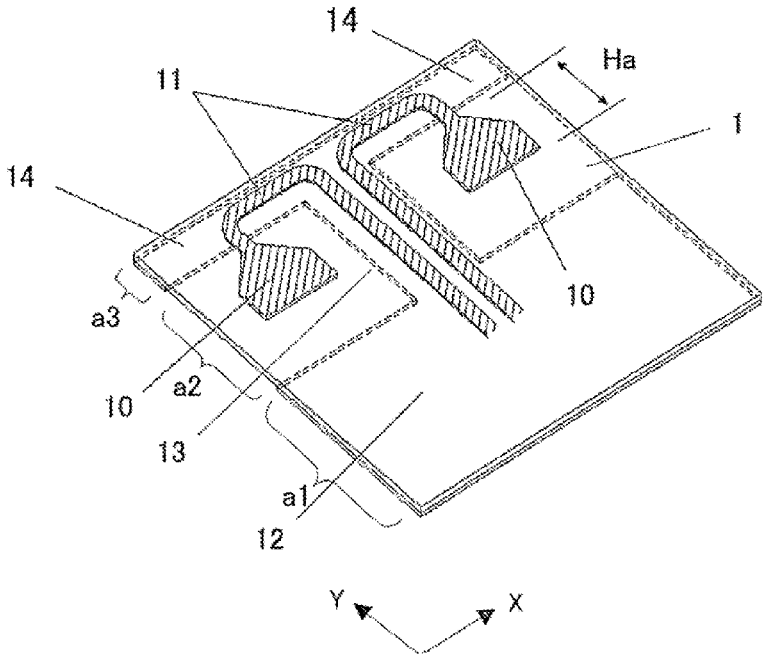
FIG. 8 is a perspective view showing the configuration of a wideband planar antenna according to a fourth example of the present invention.
Figure 9A:
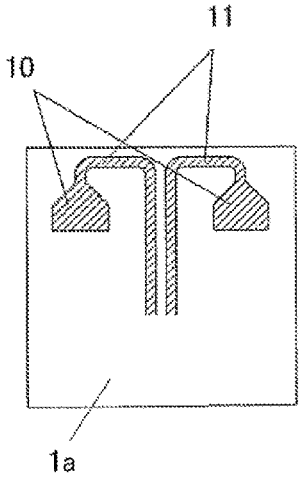
FIGS. 9A to 9C are plan views of the wideband planar antenna according to the fourth example of the present invention, FIG. 9A being a top view, FIG. 9B a rear view, and FIG. 9C a phantom view.
Figure 9B:
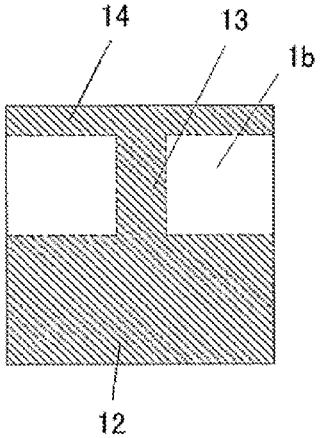
Figure 9C:
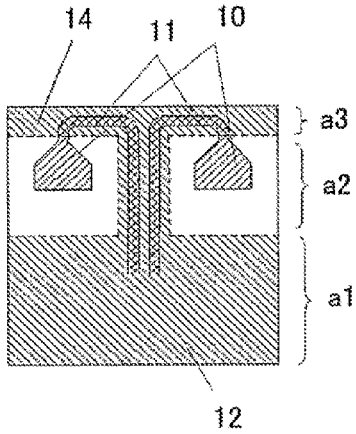

FIG. 8 is a perspective view of a wideband planar antenna according to a fourth example of the present invention. FIGS. 9A to 9C are plan views of FIG. 8. FIG. 9A shows a front view in perspective, FIG. 9B a rear view, and FIG. 9C a phantom view.

In the present example, the shape of the bodies of the plate elements 10 according to the first example is replaced with a pentagonal shape. Here, the length (height) Ha of the plate elements 10 across the axial ends is set at approximately ¼ the wavelength of the lowest use frequency. The rest of the configuration is the same as that of the first example. Like reference symbols will thus be given, and description thereof will be omitted. The present example provides the same effect as that of the first example.

EXAMPLE 5

Figure 10:
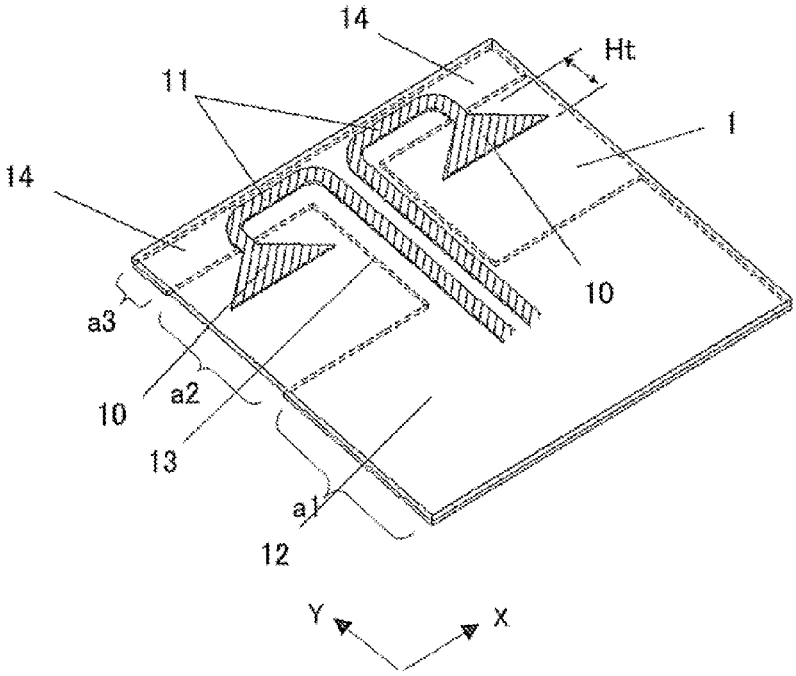
FIG. 10 is a perspective view showing the configuration of a wideband planar antenna according to a fifth example of the present invention.
Figure 11A:
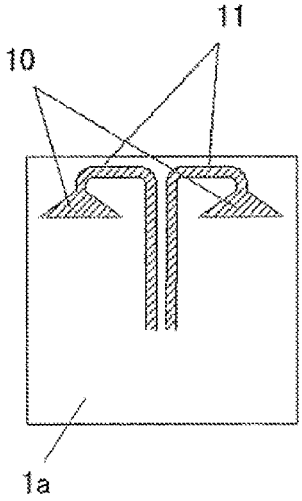
FIGS. 11A to 11C are plan views of the wideband planar antenna according to the fifth example of the present invention, FIG. 11A being a top view, FIG. 11B a rear view, and FIG. 11C a phantom view.
Figure 11B:
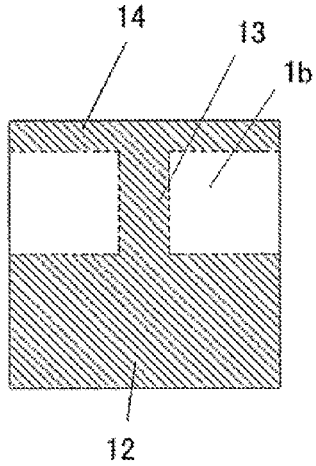
Figure 11C:
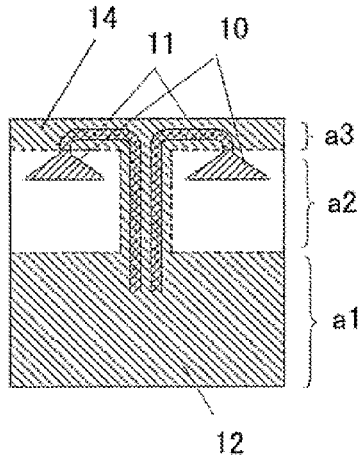

FIG. 10 is a perspective view of a wideband planar antenna according to a fifth example of the present invention. FIGS. 11A to 11C are plan views of FIG. 10. FIG. 11A shows a front view in perspective, FIG. 11B a rear view, and FIG. 11C a phantom view.

In the present example, the shape of the bodies of elements 10 according to the first example is replaced with a triangular shape. Here, the length (height) Ht of the plate elements 10 across the axial ends is set at approximately ¼ the wavelength of the lowest use frequency. The rest of the configuration is the same as that of the first example. Like reference symbols will thus be given, and description thereof will be omitted. The present example provides the same effect as that of the first example.

EXAMPLE 6

Figure 12:
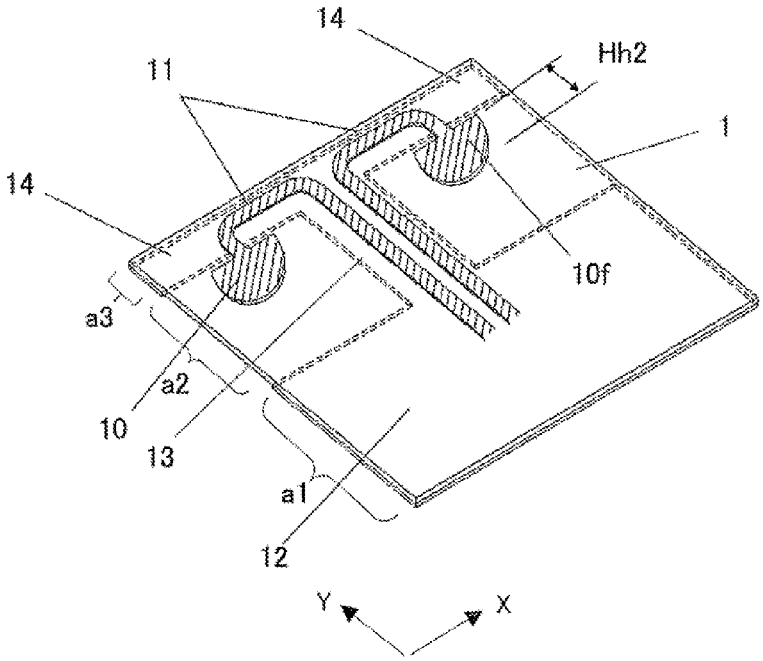
FIG. 12 is a perspective view showing the configuration of a wideband planar antenna according to a sixth example of the present invention.

FIG. 12 is a perspective view of a wideband planar antenna according to a sixth example of the present invention. FIGS.

Figure 13A:
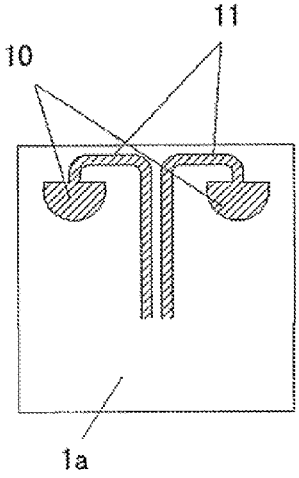
FIGS. 13A to 13C are plan views of the wideband planar antenna according to the sixth example of the present invention, FIG. 13A being a top view, FIG. 13B a rear view, and FIG. 13C a phantom view.
Figure 13B:
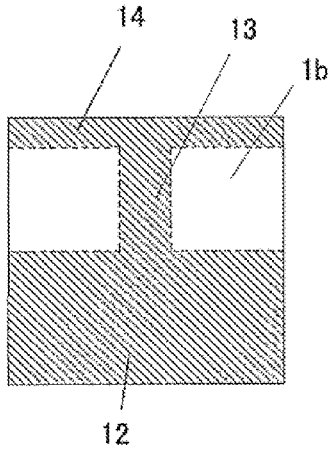
Figure 13C:
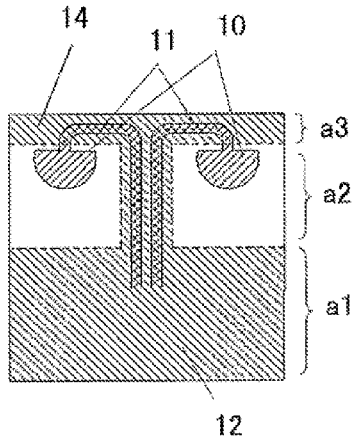

13A to 13C are plan views of FIG. 12. FIG. 13A shows a front view in perspective, FIG. 13B a rear view, and FIG. 13C a phantom view.

In the present example, the shape of the bodies of the plate elements 10 according to the first example is replaced with that of circular bodies that are cut in part, so as to allow feeding at the cut side. Here, the length (height) Hh2 of the plate elements 10 across the axial ends is set at approximately ¼ the wavelength of the lowest use frequency. The rest of the configuration is the same as that of the first example. Like reference symbols will thus be given, and description thereof will be omitted. The present example provides the same effect as that of the first example.

EXAMPLE 7

Figure 14:
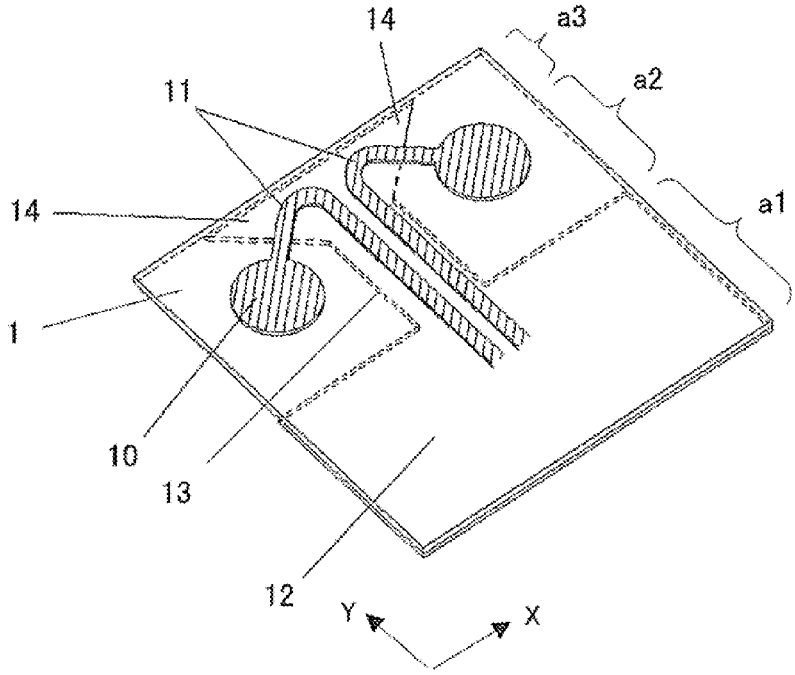
FIG. 14 is a perspective view showing the configuration of a wideband planar antenna according to a seventh example of the present invention.
Figure 15A:
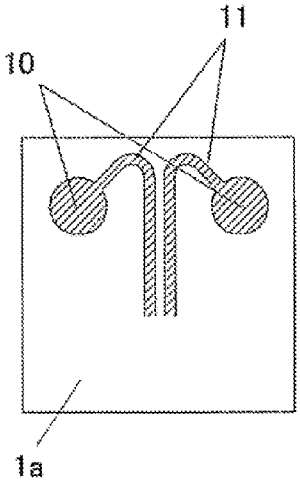
FIGS. 15A to 15C are plan views of the wideband planar antenna according to the seventh example of the present invention, FIG. 15A being a top view, FIG. 15B a rear view, and FIG. 15C a phantom view.
Figure 15B:
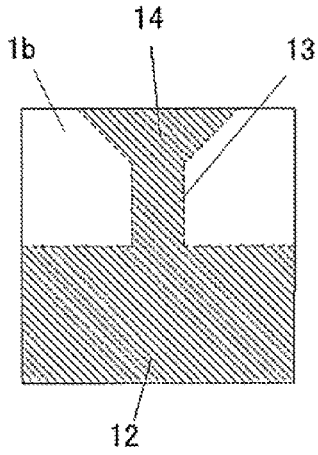
Figure 15C:
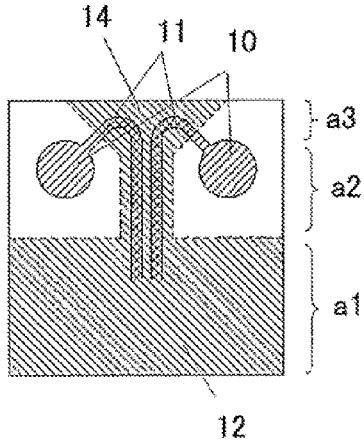

FIG. 14 is a perspective view of a wideband planar antenna according to a seventh example of the present invention. FIGS. 15A to 15C are plan views of FIG. 14. FIG. 15A shows a front view in perspective, FIG. 15B a rear view, and FIG. 15C a phantom view.

In the present example, the third ground conductor 14 of the first example is changed in shape. The third ground conductor 14 is formed in an inversely tapered configuration so that the width in the X direction increases from the second ground conductor 13 toward the end in the Y direction (the top end of the printed circuit board 1). In response to such a shape, the two plate elements 10 made of circular bodies and the two microstrip lines 11 are obliquely connected to allow feeding through the inversely tapered slopes. The rest of the configuration is the same as that of the first example. Like reference symbols will thus be given, and description thereof will be omitted.

Even in such a configuration, as with the first example, the first ground conductor 12 is arranged on the rear-end side of the printed circuit board 1, and the second ground conductor 13 and the third ground conductor 14 are arranged in an area other than the rear-end side of the printed circuit board 1, i.e., on the path that leads from the rear-end side through the center to the top-end side of the printed circuit board 1. The connections (feeding points) between the plate elements 10 and the microstrip lines are then located on the side where to face the third ground conductor 14 which is arranged on the top-end side of the printed circuit board 1, away from the first ground conductor 12 which is arranged on the rear-end side of the printed circuit board 1.

According to the present example, as with the first example, the high-frequency currents therefore concentrate on the plate elements 10 of the antenna section and on one side of the third ground conductor 14 opposite the plate elements 10 in the vicinities of the connections between the plate elements 10 and the microstrip lines 11 away from the circuit component mounting area 2 of the peripheral circuit section, and little flows into the peripheral circuit section. In consequence, the present example provides the effect of significantly reducing interactions between the antenna section and the peripheral circuit section on each other's electrical operations due to the presence of each other.

EXAMPLE 8

Figure 16:
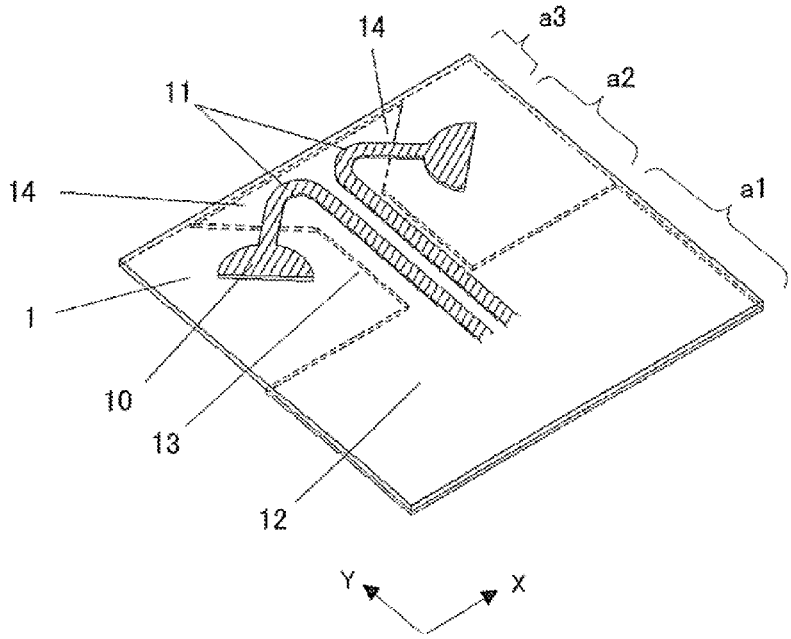
FIG. 16 is a perspective view showing the configuration of a wideband planar antenna according to an eighth example of the present invention.
Figure 17A:
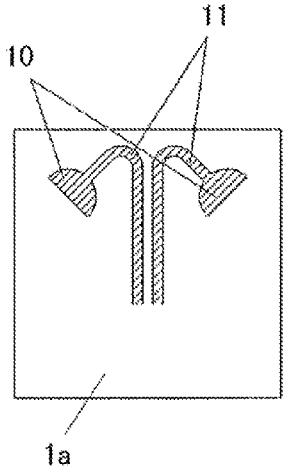
FIGS. 17A to 17C are plan views of the wideband planar antenna according to the eighth example of the present invention, FIG. 17A being a top view, FIG. 17B a rear view, and FIG. 17C a phantom view.
Figure 17B:
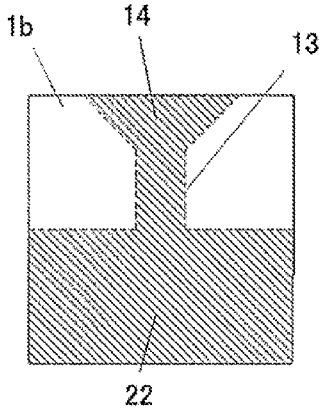
Figure 17C:
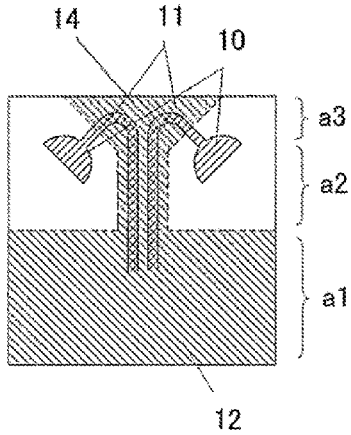

FIG. 16 is a perspective view of a wideband planar antenna according to an eighth example of the present invention. FIGS. 17A to 17C are plan views of FIG. 16. FIG. 17A shows a front view in perspective, FIG. 17B a rear view, and FIG. 17C a phantom view.

In the present example, the shape of the bodies of the plate elements 10 according to the seventh example is replaced with a semicircular shape. The rest of the configuration is the same as that of the first and seventh examples. Like reference symbols will thus be given, and description thereof will be omitted. The present example provides the same effect as that of the first and seventh examples.

EXAMPLE 9

Figure 18:
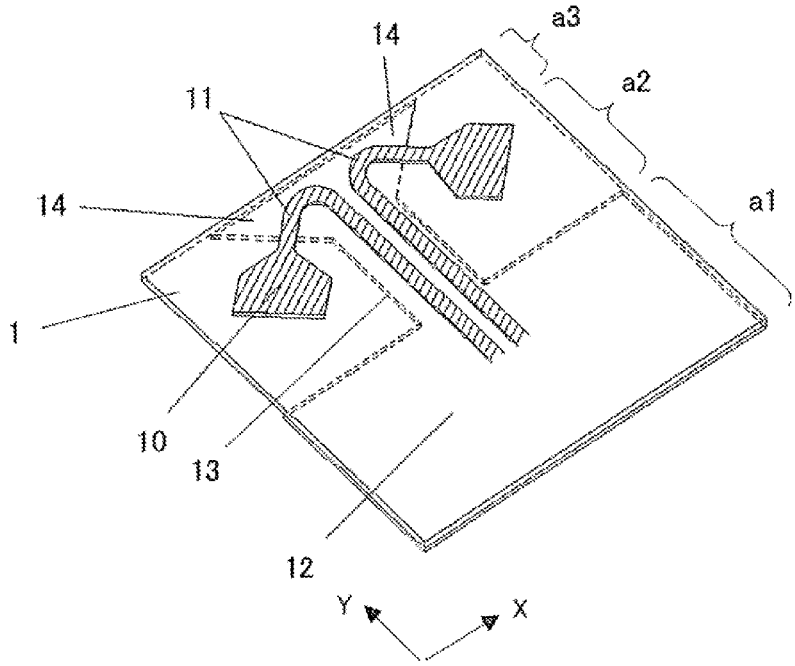
FIG. 18 is a perspective view showing the configuration of a wideband planar antenna according to a ninth example of the present invention.
Figure 19A:
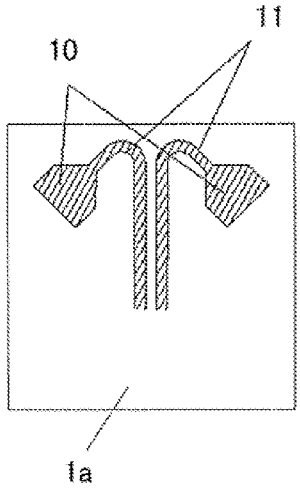
FIGS. 19A to 19C are plan views of the wideband planar antenna according to the ninth example of the present invention, FIG. 19A being a top view, FIG. 19B a rear view, and FIG. 19C a phantom view.
Figure 19B:
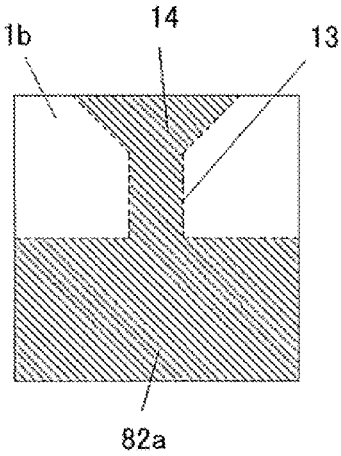
Figure 19C:
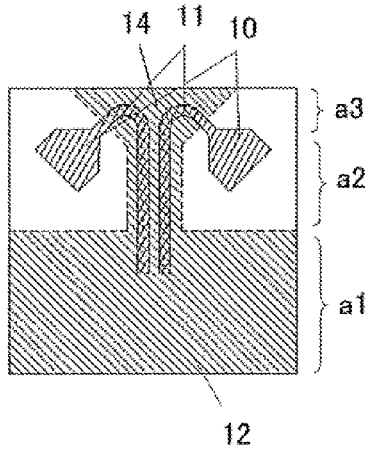

FIG. 18 is a perspective view of a wideband planar antenna according to a ninth example of the present invention. FIGS. 19A to 19C are plan views of FIG. 18. FIG. 19A shows a front view in perspective, FIG. 19B a rear view, and FIG. 19C a phantom view.

In the present example, the shape of the bodies of the plate elements 10 according to the seventh example is replaced with a pentagonal shape. The rest of the configuration is the same as that of the first and seventh examples. Like reference symbols will thus be given, and description thereof will be omitted. The present example provides the same effect as that of the first and seventh examples.

EXAMPLE 10

Figure 20:
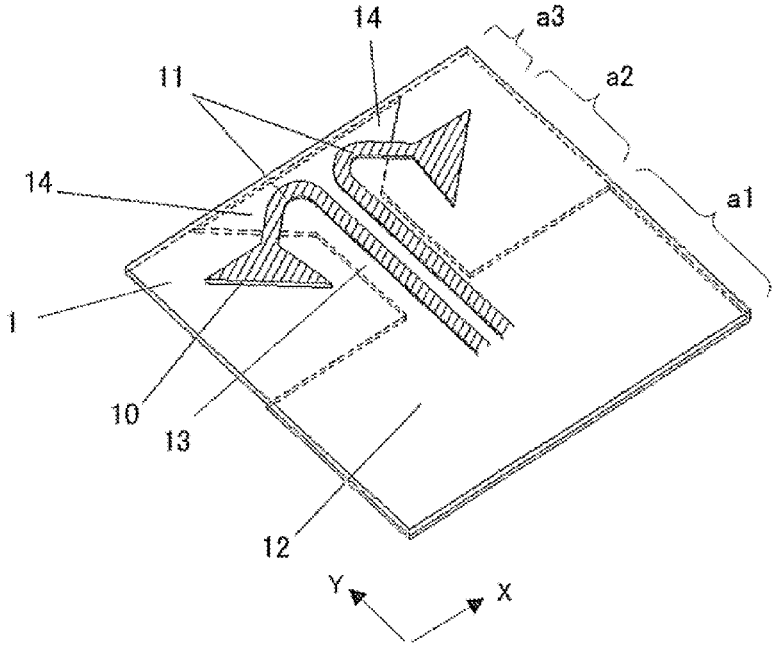
FIG. 20 is a perspective view showing the configuration of a wideband planar antenna according to a tenth example of the present invention.
Figure 21A:
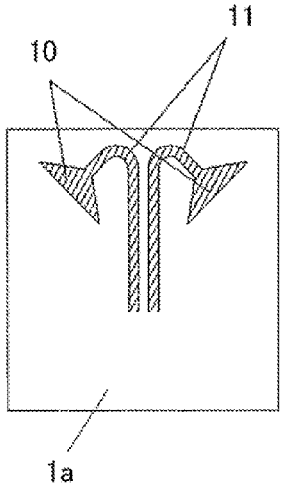
FIGS. 21A to 21C are plan views of the wideband planar antenna according to the tenth example of the present invention, FIG. 21A being a top view, FIG. 21B a rear view, and FIG. 21C a phantom view.
Figure 21B:
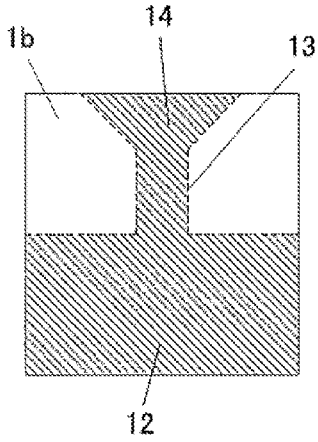
Figure 21C:
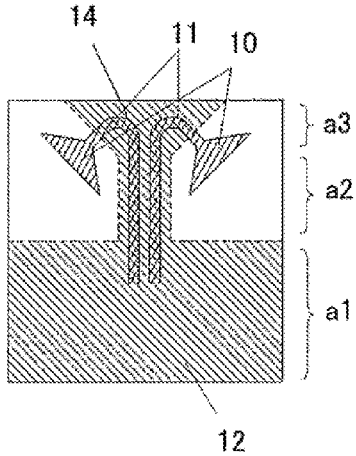

FIG. 20 is a perspective view of a wideband planar antenna according to a tenth example of the present invention. FIGS. 21A to 21C are plan views of FIG. 20. FIG. 21A shows a front view in perspective, FIG. 21B a rear view, and FIG. 21C a phantom view.

In the present example, the shape of the bodies of the plate elements 10 according to the seventh example is replaced with a triangular shape. The rest of the configuration is the same as that of the first and seventh examples. Like reference symbols will thus be given, and description thereof will be omitted. The present example provides the same effect as that of the first and seventh examples.

EXAMPLE 11

Figure 22:
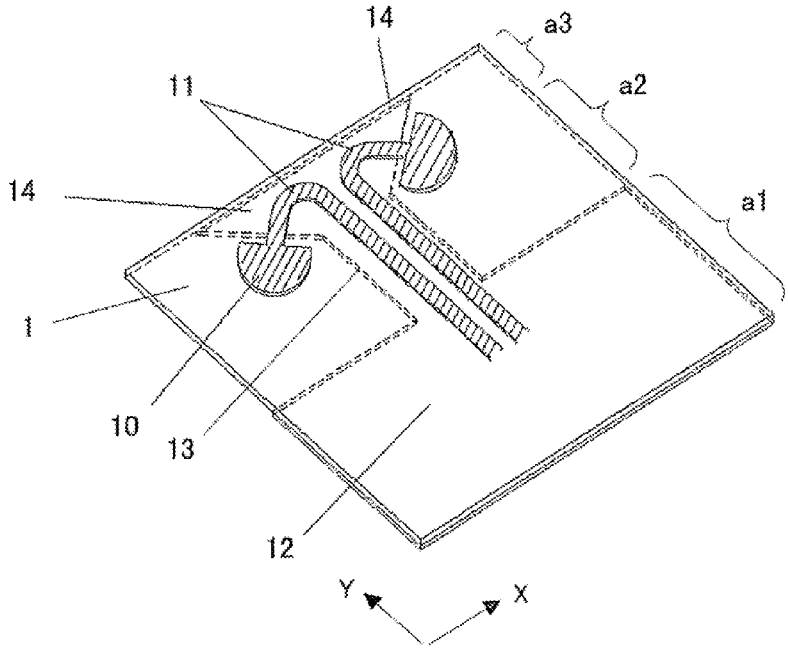
FIG. 22 is a perspective view showing the configuration of a wideband planar antenna according to an eleventh example of the present invention.
Figure 23A:
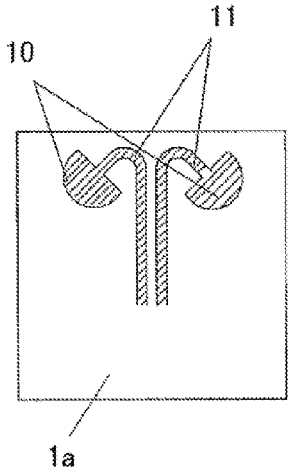
FIGS. 23A to 23C are plan views of the wideband planar antenna according to the eleventh example of the present invention, FIG. 23A being a top view, FIG. 23B a rear view, and FIG. 23C a phantom view.
Figure 23B:
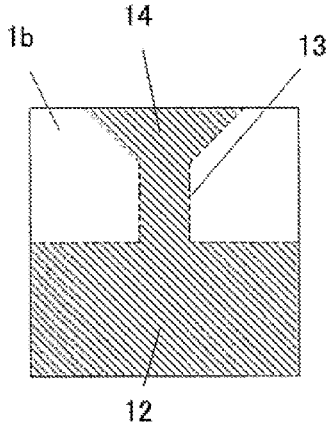
Figure 23C:
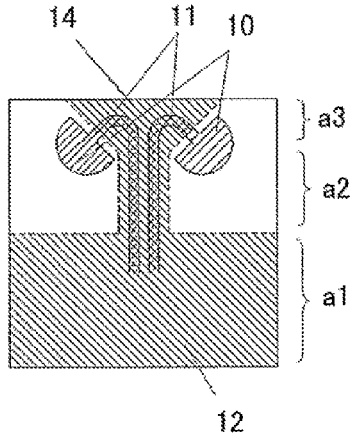

FIG. 22 is a perspective view of a wideband planar antenna according to an eleventh example of the present invention. FIGS. 23A to 23C are plan views of FIG. 22. FIG. 23A shows a front view in perspective, FIG. 23B a rear view, and FIG. 23C a phantom view.

In the present example, the shape of the bodies of the plate elements 10 according to the seventh example is replaced with that of circular bodies that are cut in part. The rest of the configuration is the same as that of the first and seventh examples. Like reference symbols will thus be given, and description thereof will be omitted. The present example provides the same effect as that of the first and seventh examples.

EXAMPLE 12

Figure 24:
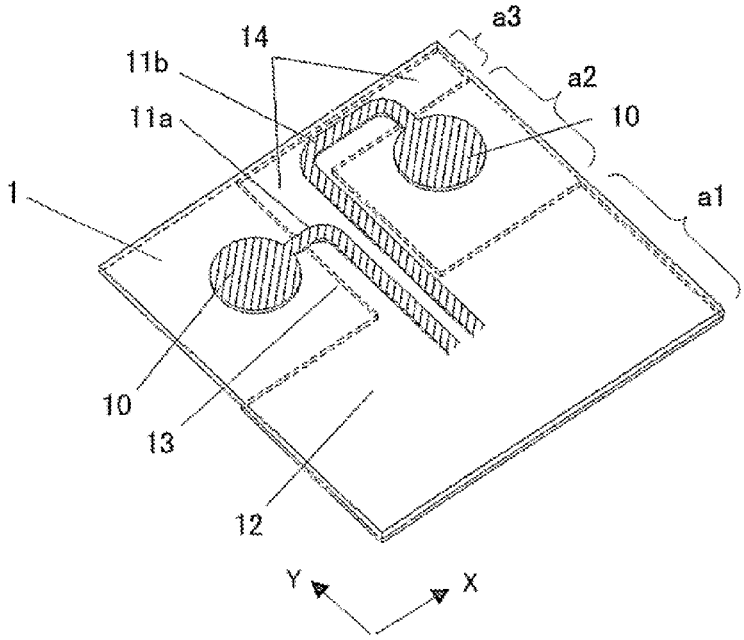
FIG. 24 is a perspective view showing the configuration of a wideband planar antenna according to a twelfth example of the present invention.
Figure 25A:
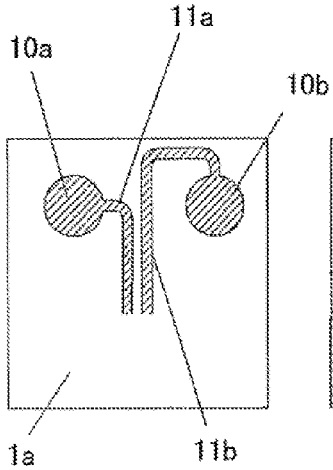
FIGS. 25A to 25C are plan views of the wideband planar antenna according to the twelfth example of the present invention, FIG. 25A being a top view, FIG. 25B a rear view, and FIG. 25C a phantom view.
Figure 25B:
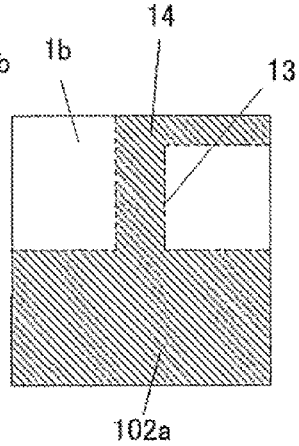
Figure 25C:
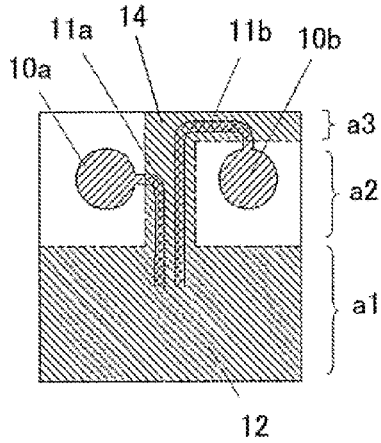

FIG. 24 is a perspective view of a wideband planar antenna according to a twelfth example of the present invention. FIGS. 25A to 25C are plan views of FIG. 24. FIG. 25A shows a front view in perspective, FIG. 25B a rear view, and FIG. 25C a phantom view.

In the present example, the third ground conductor 14 of the first example is changed in shape. The third ground conductor 14 is formed only on one side of the third area a3 in the X direction, not on the other side, with respect to the second ground conductor 13. In response to such a shape, the two plate elements 10 made of circular bodies (for convenience sake, the left-handed one and the right-handed one in the diagrams will hereinafter be distinguished by reference symbols 10*a* and 10*b*) and the two microstrip lines 11 (for convenience' sake, the left-handed one and the right-handed one in the diagrams will hereinafter be distinguished by reference symbols 11*a* and 11*b*) are connected with each other so as to allow feeding.

More specifically, one plate element 10*a* is connected with one microstrip line 11*a* so as to allow feeding within the second area a2. Here, the one microstrip line 11*a* is bent in the X-direction from a predetermined position in the second area a2 and is connected with the one plate element 10*a* in the second area a2. Meanwhile, the other plate element 10*b* is connected with the other microstrip line 11*b* so as to allow feeding as in the first example. Here, the other microstrip line 11*b* is bent in the Y direction from a predetermined position in the third area a3 and is connected with the other plate element 10*b* at the side of the second area a2. The rest of the configuration is the same as that of the first example. Like reference symbols will thus be given, and description thereof will be omitted.

Even in such a configuration, as with the first example, the first ground conductor 12 is arranged in the area on the rear-end side of the printed circuit board 1, and the second ground conductor 13 and the third ground conductor 14 are arranged in the area other than the rear-end side of the printed circuit board 1, i.e., on the path that leads from the rear-end side through the center to the top-end side of the printed circuit board 1. The connections (feeding points) between the two plate elements 10*a* and 10*b* and the two microstrip lines 11*a* and 11*b* are then located on the side where to face the second ground conductor 13 which is arranged in the center of the printed circuit board 1 and on the side where to face the third ground conductor 14 which is arranged on the top-end side of the printed circuit board 1, respectively, away from the first ground conductor 12 which is arranged on the rear-end side of the printed circuit board 1.

As with the first example, the high-frequency currents therefore concentrate on the plate elements 10*a* and 10*b* of the antenna section, on one side of the second ground conductor 13 of the printed circuit board 1 opposite the plate element 10*a*, and on one side of the third ground conductor 14 opposite the plate element 10*b* in the vicinities of the connections between the plate elements 10*a* and 10*b* and the microstrip lines 11*a* and 11*b* away from the circuit component mounting area 2 of the peripheral circuit section, and little flows into the peripheral circuit section. In consequence, the present example provides the effect of significantly reducing interactions between the antenna section and the peripheral circuit section on each other's electric operations due to the presence of each other.

EXAMPLE 13

Figure 26:
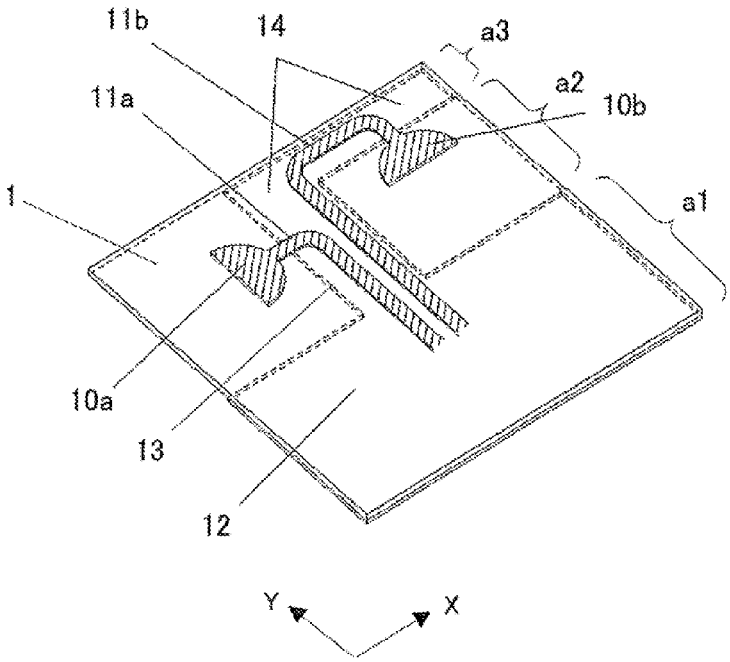
FIG. 26 is a perspective view showing the configuration of a wideband planar antenna according to a thirteenth example of the present invention.
Figure 27A:
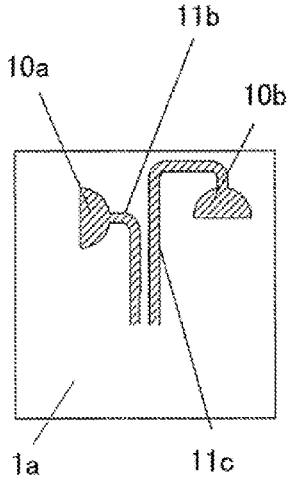
FIGS. 27A to 27C are plan views of the wideband planar antenna according to the thirteenth example of the present invention, FIG. 27A being a top view, FIG. 27B a rear view, and FIG. 27C a phantom view.
Figure 27B:
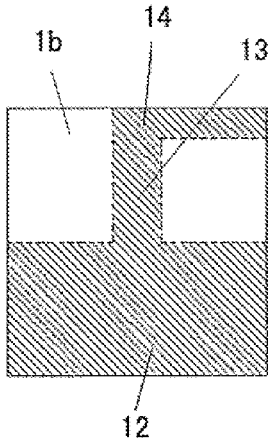
Figure 27C:
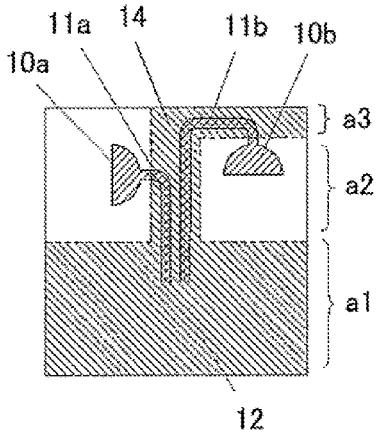

FIG. 26 is a perspective view of a wideband planar antenna according to a thirteenth example of the present invention. FIGS. 27A to 27C are plan views of FIG. 26. FIG. 27A shows a front view in perspective, FIG. 27B a rear view, and FIG. 27C a phantom view.

In the present example, the shape of the bodies of the plate elements 10 according to the twelfth example is replaced with a semicircular shape. The rest of the configuration is the same as that of the first and twelfth examples. Like reference symbols will thus be given, and description thereof will be omitted. The present example provides the same effect as that of the first and twelfth examples.

EXAMPLE 14

Figure 28:
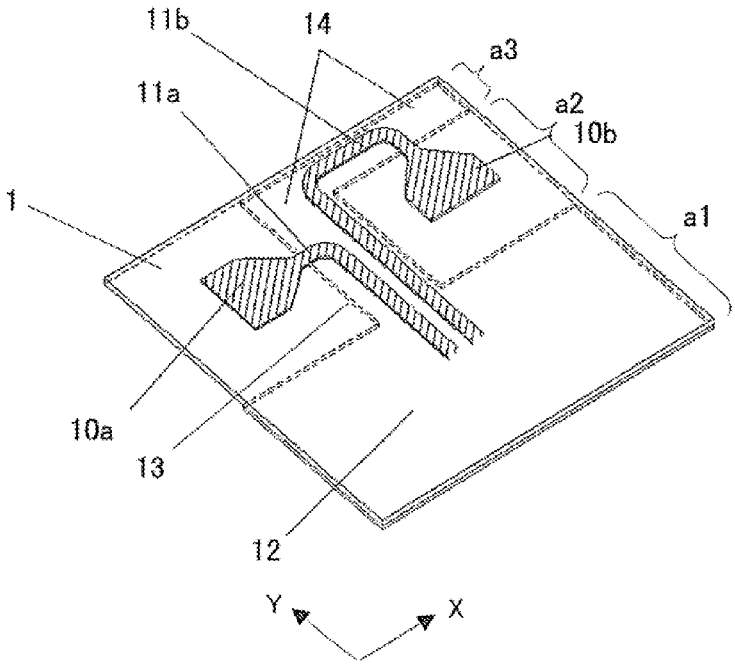
FIG. 28 is a perspective view showing the configuration of a wideband planar antenna according to a fourteenth example of the present invention.
Figure 29A:
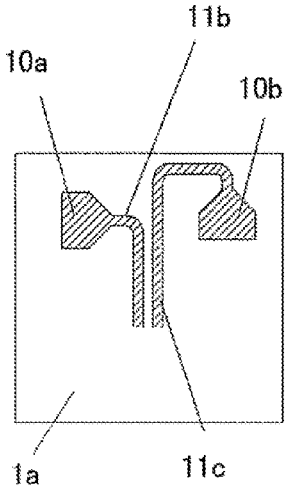
FIGS. 29A to 29C are plan views of the wideband planar antenna according to the fourteenth example of the present invention, FIG. 29A being a top view, FIG. 29B a rear view, and FIG. 29C a phantom view.
Figure 29B:
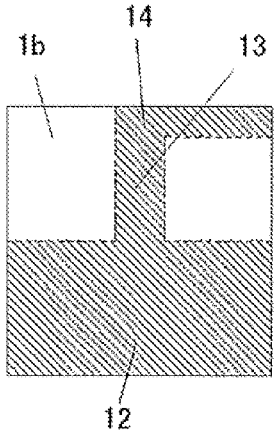
Figure 29C:
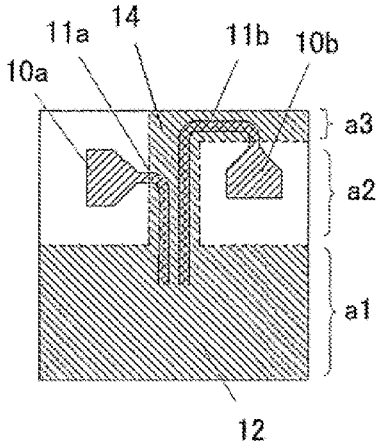

FIG. 28 is a perspective view of a wideband planar antenna according to a fourteenth example of the present invention. FIGS. 29A to 29C are plan views of FIG. 28. FIG. 29A shows a front view in perspective, FIG. 29B a rear view, and FIG. 29C a phantom view.

In the present example, the shape of the bodies of the plate elements 10 according to the twelfth example is replaced with a pentagonal shape. The rest of the configuration is the same as that of the first and twelfth examples. Like reference symbols will thus be given, and description thereof will be omitted. The present example provides the same effect as that of the first and twelfth examples.

EXAMPLE 15

Figure 30:
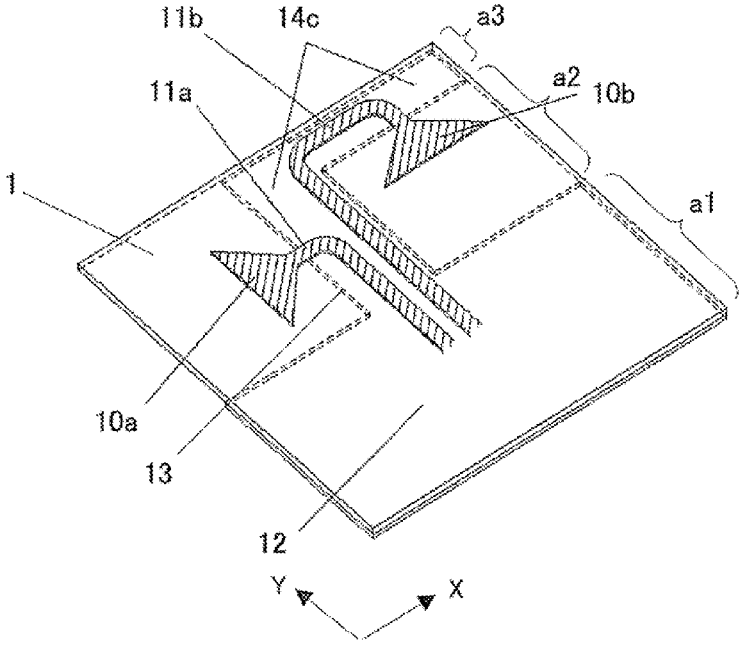
FIG. 30 is a perspective view showing the configuration of a wideband planar antenna according to a fifteenth example of the present invention.
Figure 31A:
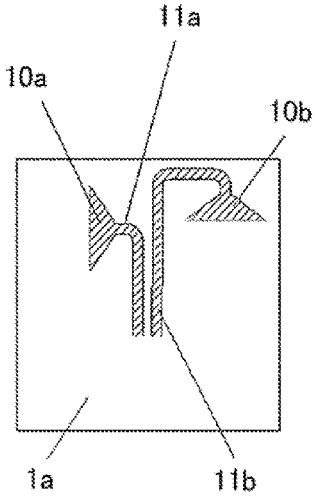
FIGS. 31A to 31C are plan views of the wideband planar antenna according to the fifteenth example of the present invention, FIG. 31A being a top view, FIG. 31B a rear view, and FIG. 31C a phantom view.
Figure 31B:
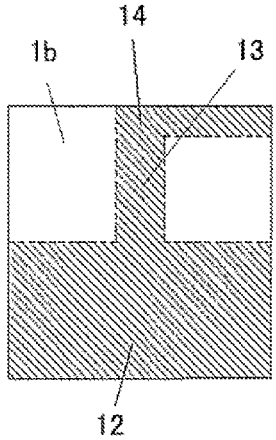
Figure 31C:
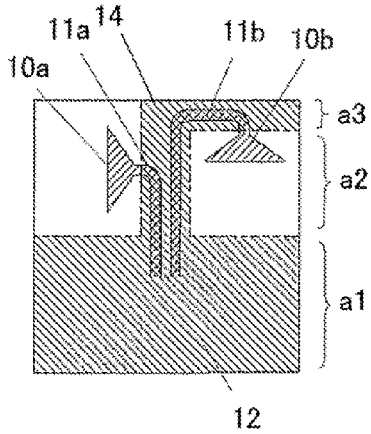

FIG. 30 is a perspective view of a wideband planar antenna according to a fifteenth example of the present invention. FIGS. 31A to 31C are plan views of FIG. 30. FIG. 31A shows a front view in perspective, FIG. 31B a rear view, and FIG. 31C a phantom view.

In the present example, the shape of the bodies of the plate elements 10 according to the twelfth example is replaced with a triangular shape. The rest of the configuration is the same as that of the first and twelfth examples. Like reference symbols will thus be given, and description thereof will be omitted. The present example provides the same effect as that of the first and twelfth examples.

(Modifications)

The plate elements of the wideband planar antenna according to the present invention are not limited to the body shapes that have been representatively shown in the foregoing examples, but other shapes may also be applied.

FIGS. 32A to 32H and 33A to 33I show shapes that may be used for the plate elements of the wideband planar antenna according to the present invention.

FIG. 32A shows an example of using a triangular plate element 10. FIG. 32B shows an example where the feeding point between the triangular plate element 10 and the microstrip line 11 is displaced to the right in the diagram. FIG. 32C shows an example of using a right triangular plate element 10. FIG. 32D shows an example where the feeding point between the right triangular plate element 10 and the microstrip line 11 is displaced to the left in the diagram.

FIG. 32E shows an example of using an elliptic plate element 10 that is obliquely cut at the top. FIG. 32F shows an example of using a triangular plate element 10 that is also obliquely cut at the top. FIG. 32G shows an example of using a rectangular plate element 10 that is also obliquely cut at the top. FIG. 32H shows an example where the feeding point between the plate element 10 shaped as shown in FIG. 32G and the microstrip line 11 is displaced to the left in the diagram.

FIG. 33A shows an example of using a plate element 10 of U shape. FIG. 33B shows an example where the U-shaped plate element 10 shown in FIG. 33A has right and left branches of different lengths. FIG. 33C shows an example of using a plate element 10 of V shape. FIG. 33D shows an example where the V-shaped plate element 10 shown in FIG. 33C has right and left branches of different lengths.

FIG. 33E shows an example of using the configuration that the V-shaped plate element 10 shown in FIG. 33C or FIG. 33D has an additional branch in the center. FIG. 33F shows an example of using the configuration that the U-shaped plate element 10 shown in FIG. 33A or FIG. 33B has an additional branch in the center.

FIG. 33G shows an example where a predetermined shape of hollow part is formed in a rectangular plate element 10. FIG. 33H shows an example where a thick strip of plate element 10 is formed in a spiral shape. FIG. 33I shows an example where a thick strip of plate element 10 is formed in an open ring shape.

The foregoing examples have dealt with the cases where the third ground conductor 14 is shaped straight in the vicinities of the connections between the plate elements 10 and the microstrip lines 11. For the sake of impedance matching, however, notches or fins such as shown in FIGS. 34A to 34D may be formed.

FIGS. 34A to 34D show examples of the shape of the third ground conductor 14 in the vicinity of the connection between a plate element 10 and a microstrip line 11.

FIG. 34A shows an example where a U-shaped notch 20 is formed in the third ground conductor 14. FIG. 34B shows an example where a V-shaped notch 21 is formed in the third ground conductor 14. FIG. 34C shows an example where fins (conductor) 22 having a curve similar to the shape of the plate element 10 are formed on the third ground conductor 14 so as to produce a slight capacitance between the plate element 10 and the fins 22 for impedance matching. FIG. 34D shows an application of FIG. 34C, an example where triangular fins (conductor) 23 are formed on the third ground conductor 14. The notches 20 and 21 and the fins 22 and 23 are each a structure for achieving impedance matching when connecting the plate element 10 and the microstrip line 11.

(Other Exemplary Embodiments)

A planar antenna according to another exemplary embodiment of the present invention has an antenna section and a peripheral circuit section which are arranged on a printed circuit board. The planar antenna includes: on one surface of the printed circuit board, a plate element that constitutes the antenna section, a microstrip line that is connected with the plate element and feeds electricity from a peripheral circuit to the plate element, and a peripheral circuit mounting area in which the peripheral circuit section is arranged; and, on the other surface of the printed circuit board, a first ground portion that constitutes a ground-side conductor of the peripheral circuit section, and a second ground portion that constitutes a ground-side conductor of the microstrip line. The second ground portion is arranged on the printed circuit board other than the first ground portion. A connection between the plate element and the microstrip line is located on the side of the second ground portion away from the first ground portion. In such a configuration, the first ground portion may be arranged on one side of the printed circuit board in a predetermined direction, and the second ground portion may be arranged on the other side of the printed circuit board in the predetermined direction. The second ground portion may be arranged on a path that leads from one side through a central part to the other side of the printed circuit board.

In the planar antenna of the foregoing configuration, the plate element may be composed of two plate elements, and the microstrip line may be composed of two microstrip lines that are connected with the two plate elements, respectively.

In the planar antenna of the foregoing configuration, the plate element(s) may have a body having any one of a circular, elliptic, semicircular, triangular, pentagonal, and other polygonal shapes. The connection (s) between the plate element(s) and the microstrip line(s) may be displaced from an axial direction of the plate element(s). The plate element(s) may be shaped so that the body is obliquely cut in part. The plate element(s) may be formed to have a hollow part in the body. The plate elements may have a body having any one of a U, V, spiral, and ring shapes.

In the planar antenna of the foregoing configuration, the second ground portion may have a notch for impedance matching in the vicinity of the connection(s) between the plate element(s) and the microstrip line(s). The second ground portion may have a fin for impedance matching in the vicinity of the connection(s) between the plate element(s) and the microstrip line(s).

A communication device according to another exemplary embodiment of the present invention includes the planar antenna according to any one of the foregoing configurations.

A card-type terminal according to another exemplary embodiment of the present invention includes the planar antenna according to any one of the foregoing configurations.

Up to this point, the exemplary embodiments and examples of the present invention have been described in detail. The present invention is not limited to the foregoing exemplary embodiments and examples that have been representatively illustrated, however. Based on the description of the appended claims, changes and modifications may be made to various aspects by those skilled in the art without departing from the gist of the present invention. Such changes and modifications are also intended to be embraced in the scope of the present invention.

Indusrial Applicability

The present invention is applicable to card-type terminals using an antenna that desirably has a small size and a wide band, such as a card terminal using WiMAX technologies, a card terminal having an antenna using UWB wireless technologies, a card terminal for wireless LAN, and a wireless card terminal for data communication.

The invention claimed is:

1. A planar antenna including an antenna section and a peripheral circuit section on an identical substrate, the planar antenna comprising:

a radiating element that is arranged in the antenna section;

a peripheral circuit that is arranged in the peripheral circuit section;

a microstrip line that connects the peripheral circuit and the radiating element to feed electricity from the peripheral circuit to the radiating element;

a first ground conductor that is intended for the peripheral circuit and is arranged on a back side of a first area where the peripheral circuit is arranged;

a second ground conductor that is intended for the microstrip line, is arranged on a back side of a second area where the microstrip line is arranged, and has a width smaller than that of the first ground conductor, a connection between the radiating element and the microstrip line being located on the side of the second area where the microstrip line is arranged, away from the first area where the peripheral circuit is arranged;

a third area that is arranged away from the first area with the second area therebetween; and a third ground conductor that is intended for the microstrip line and is arranged on a back side of the third area.

2. The planar antenna according to claim 1, wherein the connection between the radiating element and the microstrip line is located near a boundary of the second ground conductor or the third ground conductor.

3. The planar antenna according to claim 1, wherein the connection between the radiating element and the microstrip line is located near a border between the second area and the third area.

4. The planar antenna according to claim 1, wherein the radiating element is connected with the microstrip line at a side not facing the first area.

5. The planar antenna according to claim 1, wherein the radiating element is connected with the microstrip line toward the third ground conductor.

6. The planar antenna according to claim 1, wherein the microstrip line is connected with the radiating element through a bend.

7. The planar antenna according to claim 1, wherein the radiating element has the shape of a plate.

8. The planar antenna according to claim 1, wherein the radiating element includes at least any one of a circular, elliptic, semicircular, arc, polygonal, and rectangular shapes.

9. The planar antenna according to claim 8, wherein the radiating element has an axial length of approximately ¼the wavelength of a lowest use frequency.

10. The planar antenna according to claim 1, wherein:

the planar antenna is formed on the substrate; and the radiating element and the microstrip line are formed on the substrate by etching.

11. The planar antenna according to claim 1, wherein a notch for impedance matching is formed in a ground conductor in the vicinity of the connection between the radiating element and the microstrip line.

12. The planar antenna according to claim 1, wherein a fin for impedance matching is formed on a ground conductor in the vicinity of the connection between the radiating element and the microstrip line.

13. A communication device comprising the planar antenna according to claim 1.

14. A card-type terminal comprising the planar antenna according to claim 1.

* * * * *